US007385345B2

(12) United States Patent
Chang

(10) Patent No.: US 7,385,345 B2
(45) Date of Patent: Jun. 10, 2008

(54) ELECTRON EMISSION DEVICE

(75) Inventor: Cheol-Hyeon Chang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 515 days.

(21) Appl. No.: 11/043,043

(22) Filed: Jan. 27, 2005

(65) Prior Publication Data

US 2005/0179361 A1 Aug. 18, 2005

(30) Foreign Application Priority Data

Jan. 29, 2004 (KR) ..... 10-2004-0005729

(51) Int. Cl.
*H01J 1/62* (2006.01)
*H01J 63/04* (2006.01)

(52) U.S. Cl. ..... 313/496; 313/332

(58) Field of Classification Search ..... 313/495–497, 313/309, 336, 351
See application file for complete search history.

(56) References Cited

U.S. PATENT DOCUMENTS 5,821,685 A * 10/1998 Peterson ..... 313/467
5,973,452 A * 10/1999 Bojkov et al. ..... 313/495
6,509,691 B2 1/2003 Yamazaki et al.

FOREIGN PATENT DOCUMENTS

JP 10-134740 * 5/1998

* cited by examiner

*Primary Examiner*—Ashok Patel
(74) *Attorney, Agent, or Firm*—Robert E. Bushnell, Esq.

(57) ABSTRACT

An electron emission device includes a substrate, an anode electrode formed on the substrate, phosphor layers formed on the anode electrode, and resistance layers formed on the substrate and electrically connected to the anode electrode.

14 Claims, 10 Drawing Sheets

Z
Y
X
14
A
52
52
49B
52
49G
52
49R
58
56
60
60b
60a
60c
58
52
54R
52
54G
52
54B

Z
Y
X
14
A
52
58
56
49B
49G
49R
54B
54G
54R
62a
62b
62c
62

Z
Y
X
A
14
64
58
52
54B
54G
54R
49B
49G
49R
56

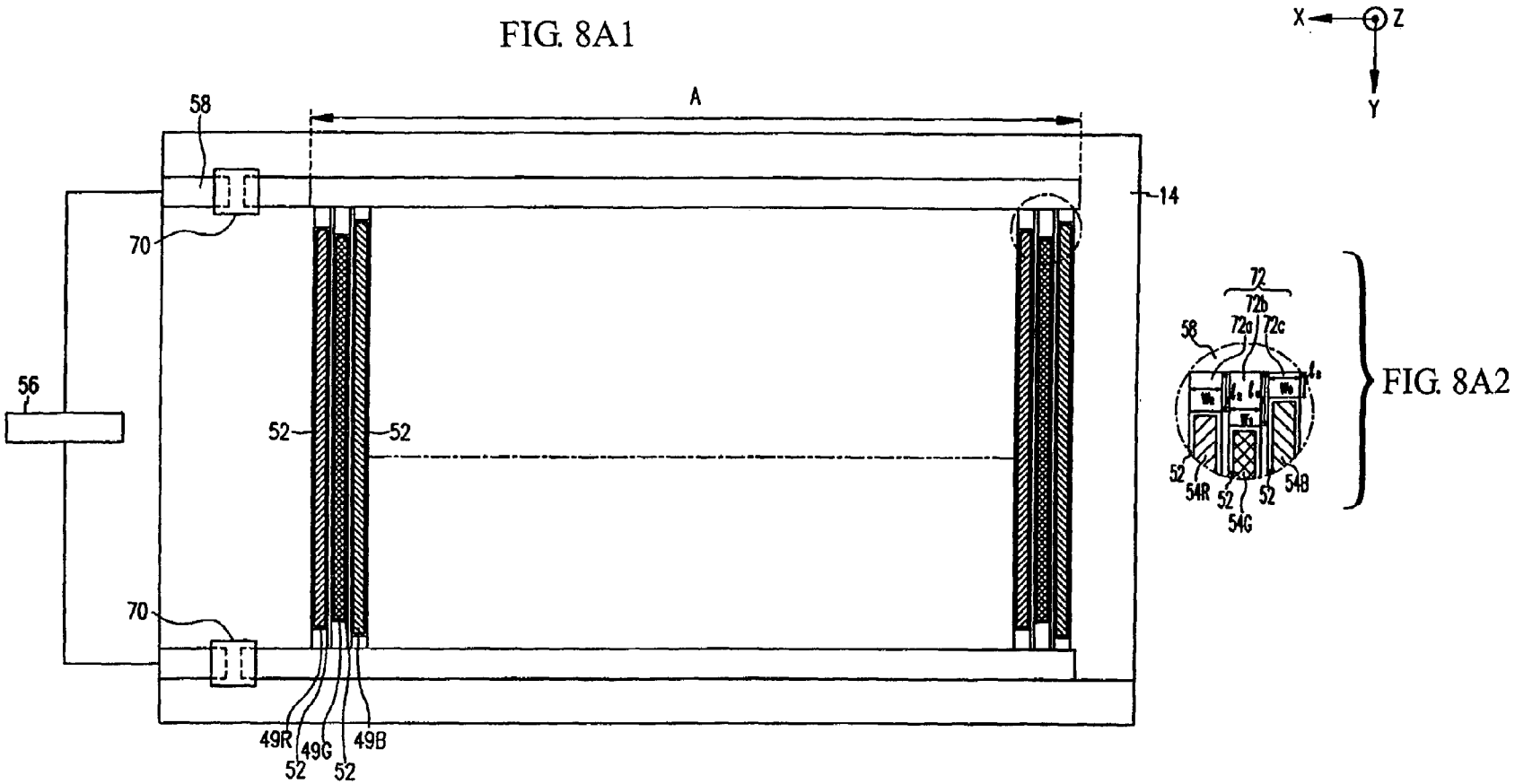
FIG. 8A2
FIG. 8A1
Z
Y
X
14
A
52
49B
49G
49R
58
70
56
72
72b
72c
54B
54G
54R

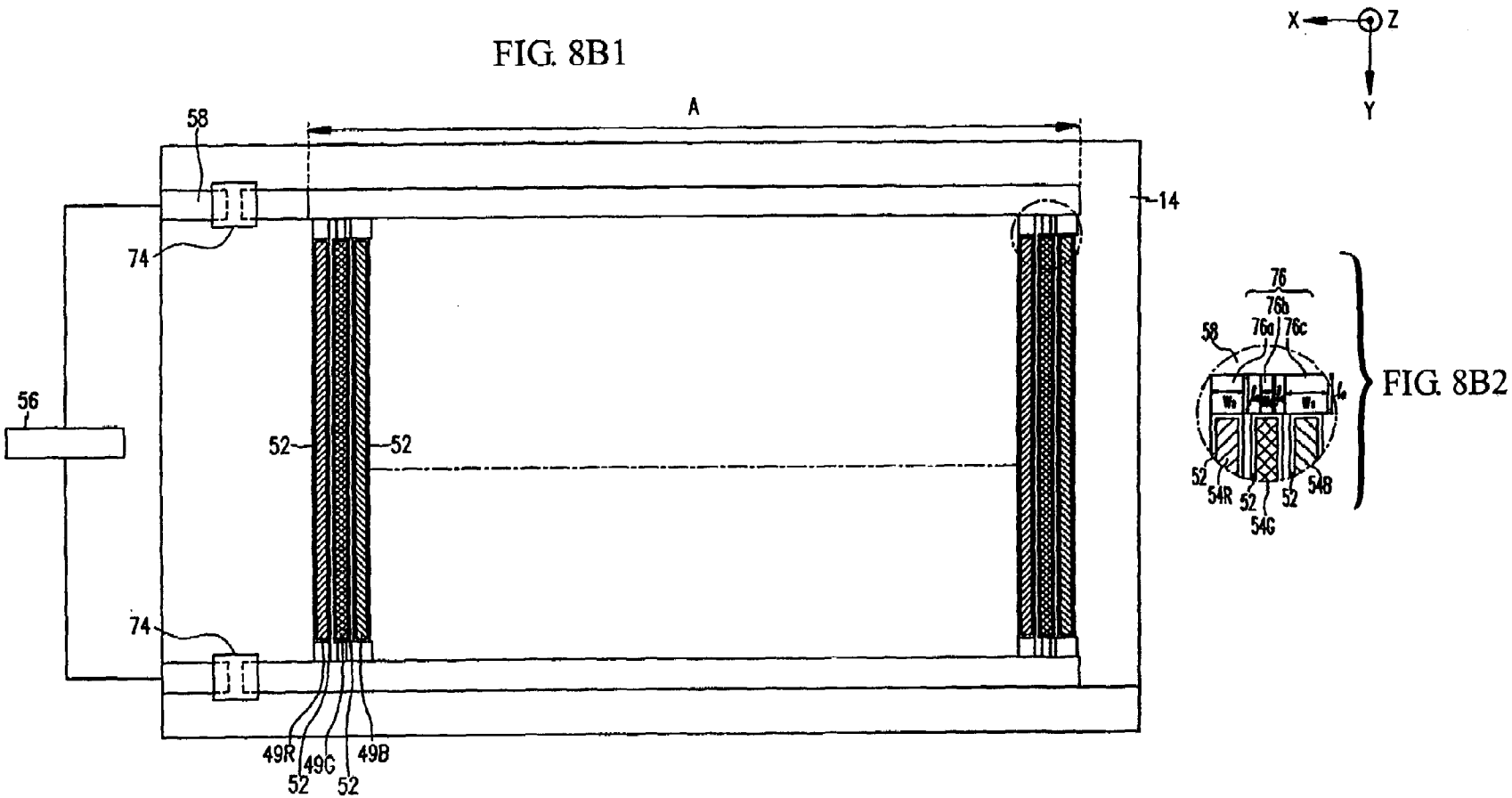
FIG. 8B1
FIG. 8B2
Z
Y
X
A
14
52
49B
49G
49R
58
74
56
76
76a
76b
76c
54B
54G
54R

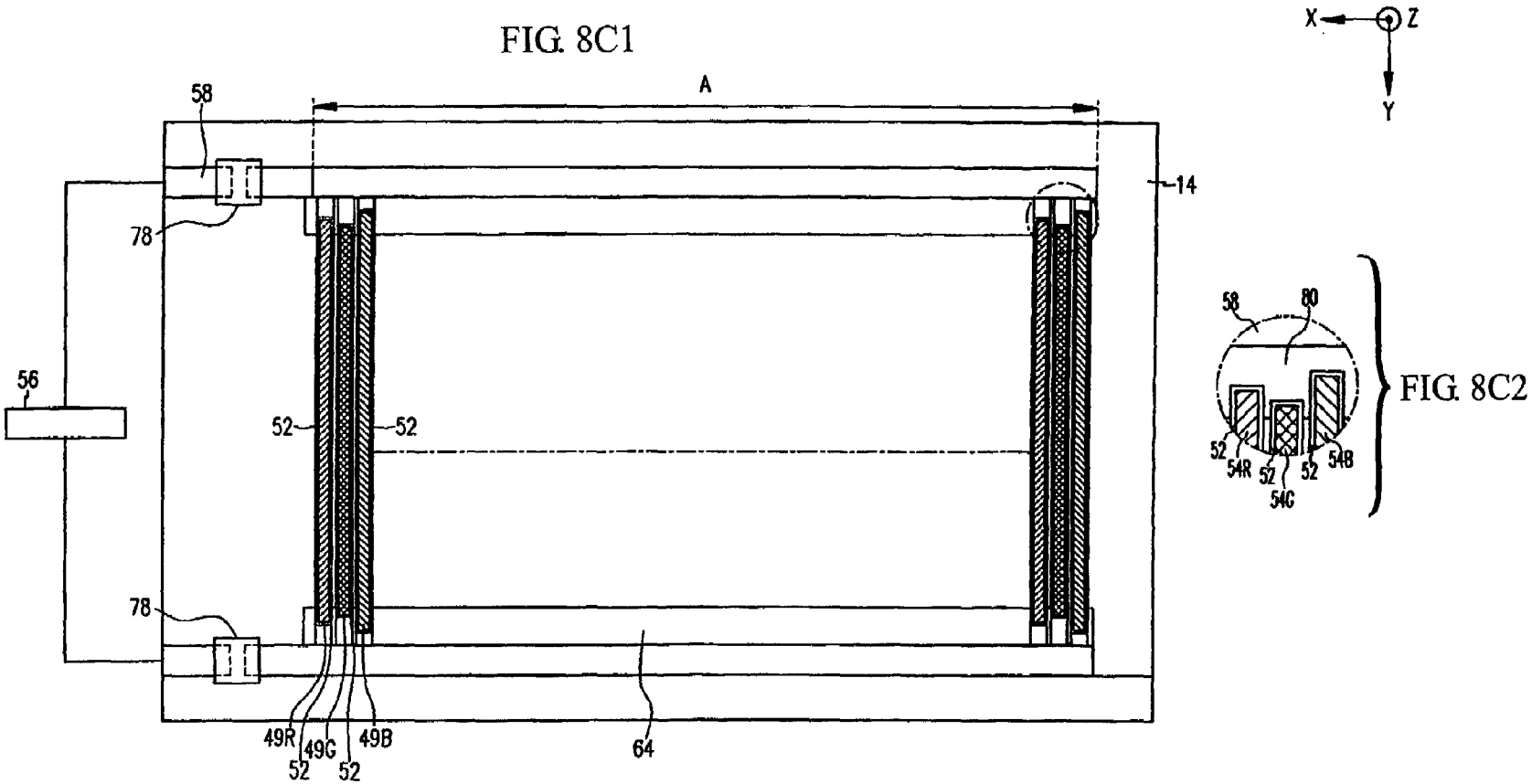
FIG. 8C1
FIG. 8C2
Z
Y
X
14
A
64
52
49B
49G
49R
58
78
56
80
54B
54G
54R

ELECTRON EMISSION DEVICE

CLAIM OF PRIORITY

This application makes reference to, incorporates the same herein, and claims all benefits accruing under 35 U.S.C. §119 from an application entitled ELECTRON EMISSION DEVICE filed with the Korean Intellectual Property Office on 29 Jan. 2004, and there duly assigned Serial No. 10/2004/0005729.

BACKGROUND OF THE INVENTION

1. Field of the Invention

The present invention relates to an electron emission device, and in particular, to a substrate for an electron emission device with an anode electrode and phosphor layers.

2. Description of Related Art

Generally, electron emission devices are classified into a first type where a hot cathode is used as an electron emission source, and a second type where a cold cathode is used as the electron emission source.

Second type electron emission devices include a Field Emitter Array (FEA) device, a Surface Conduction Emitter (SCE) device, a Metal-Insulator-metal (MIM) device, a Metal-Insulator-Semiconductor (MIS) device, and a Ballistic electron Surface Emitting (BSE) device.

The electron emission devices are differentiated in their specific structure depending upon the types thereof, but basically have an electron emission unit placed within a vacuum vessel to emit electrons, and an image display unit facing the electron emission unit in the vacuum vessel to emit light or to display the desired images.

With the FEA electron emission device, electrons are emitted from electron emission regions due to the electric fields formed when driving voltages are supplied to the driving electrodes placed around the electron emission regions.

However, with the electron emission device, since the distance between the substrates for forming the vacuum vessel is kept within several millimeters, and the anode electrode has a potential of several kilovolts to effect a stable luminance and lifetime effects, arcing is liable to occur due to the remnant gas within the vacuum vessel so that the image display unit can be damaged.

When the unwanted arcing occurs due to the remnant gas within the vacuum vessel, a relatively high electric current compared to the reference electric current flows through the electrode supplied with the anode voltage so that the electrode can be damaged, or the phosphor layers for the image display unit can be damaged while firing or scattering the phosphors. Consequently, the electron emission device is permanently flawed or is seriously damaged while being subjected to unrecoverable device failure.

Furthermore, with the full color electron emission device, the anode voltage is evenly supplied to the electrodes corresponding to the phosphor layers without being differentiated per the respective red, green and blue phosphor layers. In this case, the voltage application cannot properly cope with the luminance characteristics of the phosphor layers that are different from each other per the respective colors so that the luminance uniformity is deteriorated.

SUMMARY OF THE INVENTION is an object of the present invention to provide an electron emission device which can vary the anode voltage supplied to the anode electrode depending upon the values of the electric current supplied to the anode electrode.

It is another object of the present invention to provide an electron emission device which can supply the anode voltages well adapted for the characteristics of the red, green and blue phosphor layers to the anode electrodes corresponding to the red, green and blue phosphor layers.

These and other objects can be achieved by an electron emission device with the following features.

The electron emission device includes a first substrate, an anode electrode formed on the substrate, phosphor layers formed on the anode electrode, and resistance layers formed on the substrate and electrically connected to the anode electrode.

The resistance layers can be structurally separated from the anode electrode.

The resistance layers can be formed at the area of anode voltage lead-in portions formed on the substrate and electrically connected to the anode electrode.

Two or more voltage lead-in portions can be formed on the substrate. Each resistance layer is disposed between the voltage lead-in portions and electrically connected to the voltage lead-in portions.

The anode electrode can be plane-shaped corresponding to the entire effective display area defined over the substrate.

The anode electrode can be formed on the substrate with a transparent material. The phosphor layers are patterned on the anode electrode.

The phosphor layers can be patterned on the substrate. The anode electrode is formed on the substrate with a metallic material and covers the phosphor layers.

A plurality of anode electrodes can be patterned on the substrate.

The resistance layers can be disposed between anode voltage lead-in portions formed on the substrate and the plurality of anode electrodes and electrically connected thereto.

The resistance layers can be separately formed on the substrate in one to one correspondence with the plurality of anode electrodes.

The resistance layers can have different resistance values depending upon the colors of the phosphor layers formed on the plurality of anode electrodes.

The resistance layers corresponding to the different-colored phosphor layers can have the same width, but different lengths. The phosphor layers are formed with red, green and blue phosphor layers. When the length of the resistance layer corresponding to the red phosphor layer is indicated by $l_R$, the length of the resistance layer corresponding to the green phosphor layer by $l_G$ and the length of the resistance layer corresponding to the blue phosphor layer by $l_B$, then the resistance layers satisfy the following condition: $l_G>l_R>l_B$.

The resistance layers corresponding to the different-colored phosphor layers can have the same length, but different widths. The phosphor layers are formed with red, green and blue phosphor layers. When the width of the resistance layer corresponding to the red phosphor layer is indicated by $w_R$, the width of the resistance layer corresponding to the green phosphor layer by $w_G$ and the width of the resistance layer corresponding to the blue phosphor layer by $w_B$, then the resistance layers satisfy the following condition: $w_B>w_R>w_G$.

The resistance layer can be singly connected to the plurality of anode electrodes. The plurality of anode electrodes have different lengths corresponding to the different-colored phosphor layers.

The resistance layer comprises a first resistance layer formed at the area of an anode voltage lead-in portion on the substrate and connected to the anode electrode, and a second resistance layer disposed between the anode voltage lead-in portion and the anode electrode and electrically connected thereto.

The thickness of the first resistance layer is greater than the thickness of the second resistance layer.

The electron emission device further includes a second substrate facing the first substrate, and an electron emission unit formed on the second substrate. The electron emission unit includes cathode electrodes formed on the second substrate, electron emission regions formed on the cathode electrodes, and gate electrodes formed over the cathode electrodes and interposing an insulating layer.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein:

FIGS. 8A1 to 8C1 and 8A2 to 8C2 are plan views and magnified portions of an electron emission device according to a third embodiment of the present invention, including the main components formed on the anode substrate thereof.

DETAILED DESCRIPTION OF THE PRESENT INVENTION

The present invention will be described more fully hereinafter with reference to the accompanying drawings, in which exemplary embodiments of the present invention are shown.

Figure 1:
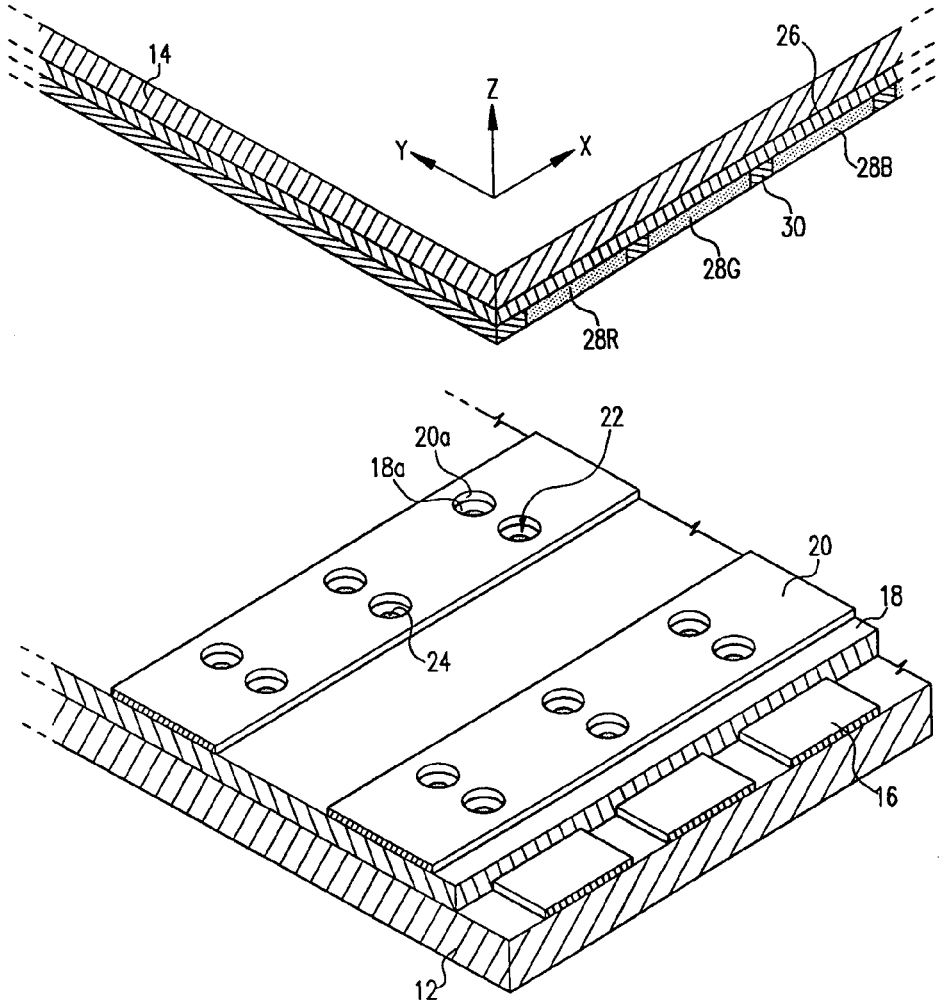
FIG. 1 is a partial exploded perspective view of an electron emission device according to an embodiment of the present invention.
Figure 2:
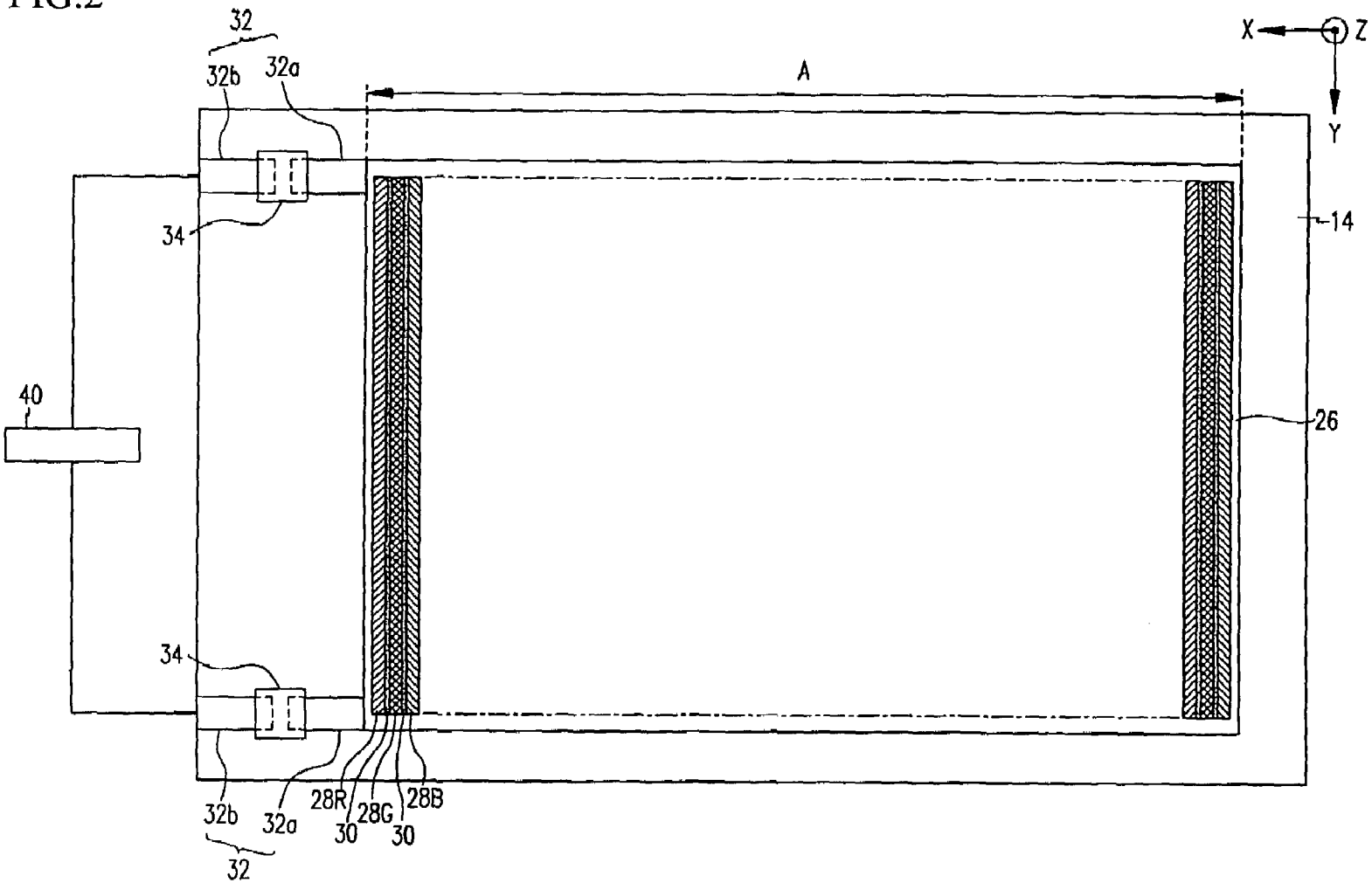
FIG. 2 is a plan view of an electron emission device according to a first embodiment of the present invention, including the main components formed on the anode substrate thereof.

FIG. 1 is a partial exploded perspective view of an electron emission display according to an embodiment of the present invention, and FIG. 2 is a plan view of the electron emission display, including the main structural components of the anode substrate thereof.

As shown in the drawings, the electron emission device includes a cathode substrate 12 and an anode substrate 14 facing each other and spaced apart to form a vacuum vessel. An electron emission unit is provided at the cathode substrate 12 to emit electrons. An image display unit is provided at the anode substrate 14 to emit light and display the desired images.

Specifically, stripe-patterned cathode electrodes 16 are arranged on the cathode substrate 12. An insulating layer 18 is formed on the cathode electrodes 16, and stripe-patterned gate electrodes 20 are arranged on the insulating layer 18 in a direction crossing the cathode electrodes 16.

Holes 22 are formed at the crossed pixel regions of the cathode and the gate electrodes 16 and 20 to partially expose the cathode electrodes 16. Electron emission regions 24 are formed on the cathode electrodes 16 exposed through the holes 22 by an electron emission material. The holes 22 includes holes 18*a* formed in the insulating layer 18, and holes 20*a* formed in the gate electrodes 20 connected to each other.

The electron emission regions 24 are formed by a carbonaceous material or a nanometer-sized material. The carbonaceous material is selected from graphite, diamond, diamond-like carbon, carbon nanotubes, $C_{60}$ (fulleren), or a combination thereof. The nanometer-sized material is selected from nanotubes, nanofibers, or nanowires.

In this embodiment, the electron emission regions 24 are formed by carbon nanotubes.

An anode electrode 26 is formed on the anode substrate 14 facing the cathode substrate 12. Phosphor layers 28R, 28G and 28B are formed on the anode electrode 26 by red, green and blue phosphors. Black layers 30 are formed between the phosphor layers 28R, 28G and 28B to enhance the contrast.

The structure of the anode substrate 14 will be further explained with reference to FIG. 2. A plane anode electrode 26 is formed at the effective display area A defined on the anode substrate 14 facing the cathode substrate by a transparent conductive material, such as ITO. Phosphor layers 28R, 28G and 28B and black layers 30 are formed on the anode electrode 26.

Anode voltage lead-in portions (referred to hereinafter simply as lead-in portions) 32 are formed on the anode substrate 14 external to the effective display area A to supply the driving voltage from an anode electrode control circuit 40 to the anode electrode 26.

The lead-in portions 32 are electrically connected to the anode electrode 26. The shape or location of the lead-in portions 32 is not limited to that illustrated in FIG. 2, but can be varied provided that it can supply the driving voltage to the anode electrode 26.

A resistance layer 34 is provided on the anode substrate 14. When the unexpected electric current due to the arcing within the vacuum vessel of the electron emission display is supplied to the anode electrode 26, the resistance layer 34 prevents the anode electrode 26 and/or the phosphor layers 28R, 28G and 28B from being damaged.

In this embodiment, the resistance layer 34 is formed at the area of the lead-in portions 32 and separated from the anode electrode 26.

The lead-in portions 32 include a first lead-in portion 32*a* connected to the anode electrode 26, and a second lead-in portion 32*b* connected to the anode electrode control circuit 40. The resistance layer 34 is disposed between the first and the second lead-in portions 32*a* and 32*b* and electrically connected thereto.

As described above, when two or more lead-in portions 32 are provided to interconnect the anode electrode control circuit 40 and the anode electrode 26, and a resistance layer 34 is disposed between the lead-in portions 32 while interconnecting them, even if the unexpected electric current generated due to the arcing within the vacuum vessel (during the aging process, or the initial turning on of the electron emission device) is supplied to the anode electrode 26 via the lead-in portions 32, a voltage drop is induced by the resistance layer 34 so that the anode voltage is momentarily lowered.

Accordingly, the breakage of the anode electrode 26, such as the splitting thereof, can be prevented while prohibiting the bad effects exerted due to the scattering and depositing of the phosphors of the phosphor layers 28R, 28G and 28B to the side of the cathode substrate 12. In this way, the possible damage to the phosphor layers 28R, 28G and 28B as well as the electron emission device can be prevented.

Figure 3:
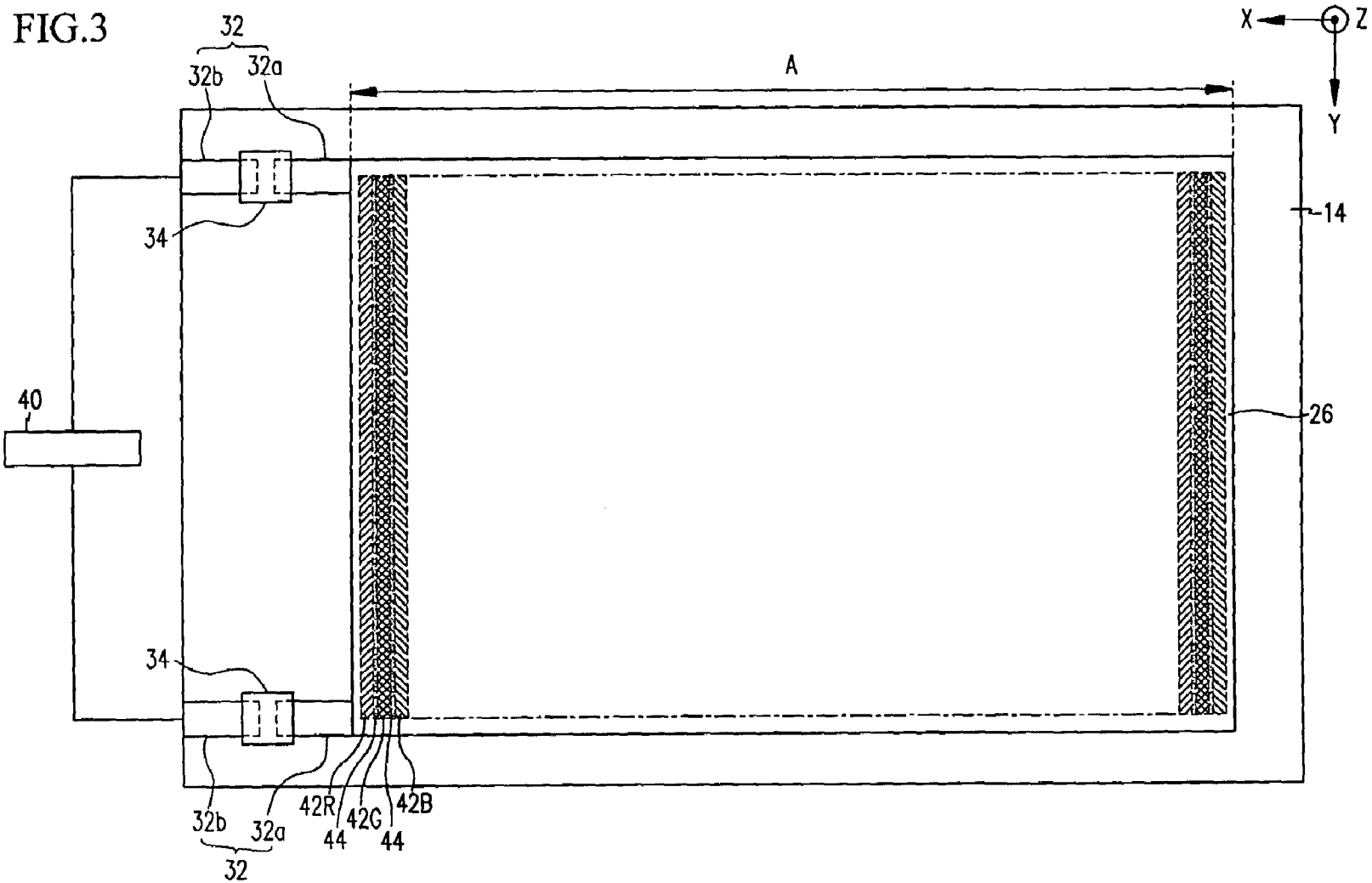
FIG. 3 is a plan view of a first variant of the electron emission device according to the first embodiment of the present invention.

FIG. 3 is a view of a first variant of the electron emission display according to the first embodiment of the present invention, in which the arrangement of the anode electrode and the phosphor layers is varied.

With the electron emission display according to the first embodiment, an anode electrode 26 is first formed on the anode substrate 14, and phosphor layers 28R, 28G and 28B are formed on the anode electrode 26. By contrast, with the first variant of the electron emission display, phosphor layers 42R, 42G and 42B and black layers 44 are first formed on the anode substrate 14, and an anode electrode 46 is formed on the anode substrate 14 and covers the phosphor layers 42R, 42G and 42B.

The anode electrode 46 is formed by a metallic material, such as aluminum, and functions both as an anode electrode and as a reflective layer for enhancing the luminance of the electron emission device. Since the function of a reflective layer is well known in the electron emission display field, a detailed explanation thereof has been omitted.

Figure 4:
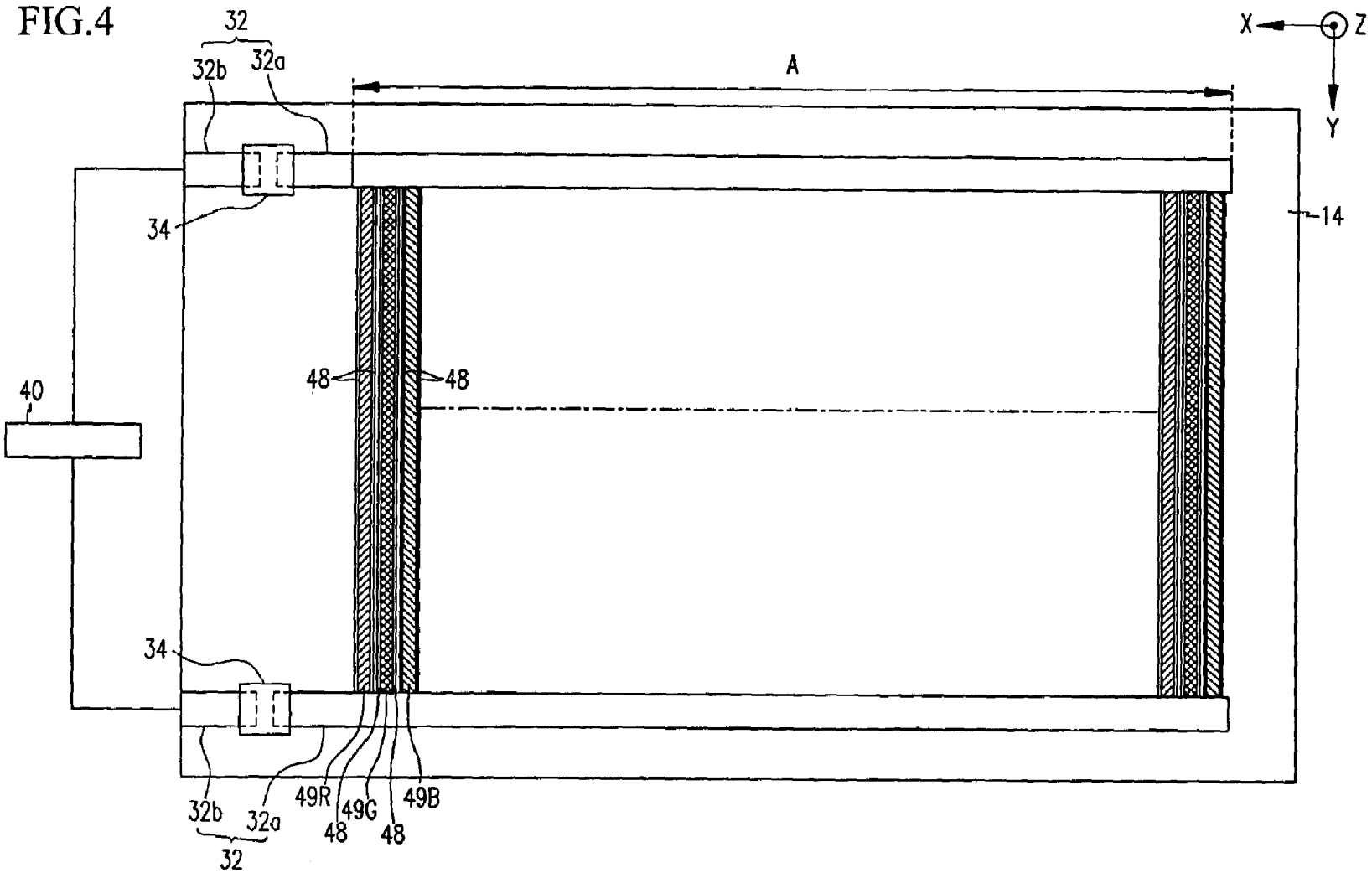
FIG. 4 is a plan view of a second variant of the electron emission device according to the first embodiment of the present invention.

FIG. 4 is a view of a second variant of the electron emission display according to the first embodiment of the present invention, in which the anode electrode is structurally varied.

With the second variant of the electron emission display, a plurality of stripe-patterned anode electrodes 48 are longitudinally arranged on the anode substrate 14 in the short axis (Y) direction of the anode substrate 14. The anode electrodes 48 are connected to the first lead-in portions 32*a* of the lead-in portions 32, and red, green and blue phosphor layers 49R, 49G and 49B are formed on the anode electrodes 48.

With the first and the second variants of the electron emission display, only the anode electrode is patterned differently, and the structure and operation of the resistance layer are the same as those with the first embodiment. Accordingly, a detailed explanation of the latter has been omitted.

Figures 5A, 5B:
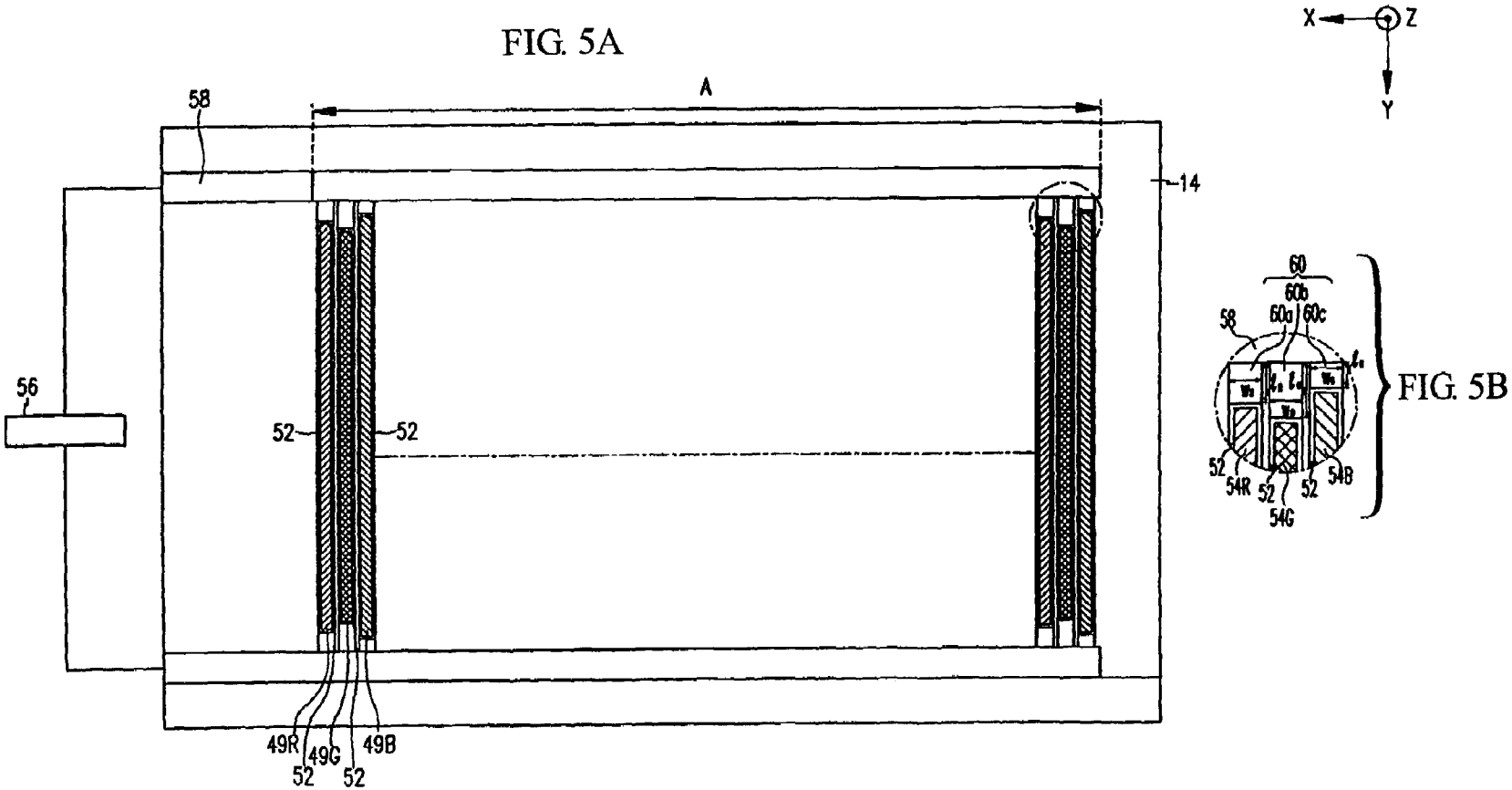
FIGS. 5A and 5B is a plan view and magnified portion of an electron emission device according to a second embodiment of the present invention, including the main components formed on the anode substrate thereof.

FIGS. 5A and 5B is a plan view and a magnified view of an anode substrate of an electron emission device according to a second embodiment of the present invention, including the main components thereof.

In this embodiment, a plurality of anode electrodes 52 are formed on the effective display area A defined on the anode substrate 50, and red, green and blue phosphor layers 54R, 54G and 54B are formed on the anode electrodes 52. The anode electrodes 52 are stripe-patterned while longitudinally proceeding in the short axis (Y) direction of the anode substrate 50, as with the anode electrodes of FIG. 4.

The anode electrodes 52 are formed on the anode substrate 50 and electrically connected to the lead-in portions 58, which are in turn electrically connected to the anode electrode control circuit 56.

Furthermore, resistance layers 60 are formed on the anode substrate 50 and electrically connected to the lead-in portions 58, and the anode electrodes 52.

The resistance layers 60 are connected to the anode electrodes 50 respectively, and structured such that they have different resistance values depending upon the colors of the red, green and blue phosphor layers 54R, 54G and 54B.

For instance, the resistance layers 60*a*, 60*b* and 60*c* corresponding to the red, green and blue phosphor layers 54R, 54G and 54B have the same width but are differentiated in length and forming a rectangular shape.

The lengths of the respective resistance layers 60*a*, 60*b* and 60*c* satisfy the following condition: $l_G > l_R > l_B$.

With the absence of the resistance layers 60, when the same anode voltage is supplied to the anode electrodes 50, the red, green and blue phosphor layers 54R, 54G and 54B are differentiated in luminance so that the luminance uniformity of the electron emission device is deteriorated. Accordingly, different anode voltages are supplied to the red, green and blue phosphor layers via the resistance layers 60*a*, 60*b* and 60*c* to uniformly maintain the luminance thereof.

That is, the resistance layer 60*c* corresponding to the blue phosphor layer 54B exhibiting the lowest luminance characteristic has the shortest length $l_B$, and the resistance layer 60*a* corresponding to the green phosphor layer 54G exhibiting the highest luminance characteristic has the longest length $l_G$. Consequently, anode voltages with different values are supplied to the anode electrodes 52 corresponding to the red, green and blue phosphor layers 54R, 54G and 54B.

As described above, different electric currents flow to the respective anode electrodes 52 corresponding to the red, green and blue phosphor layers 54R, 54G and 54B, thereby compensating for the luminance characteristics of the red, green and blue phosphor layers 54R, 54G and 54B, enhancing the luminance uniformity of the electron emission device, and ideally realizing the luminance balance.

Figures 6A, 6B:
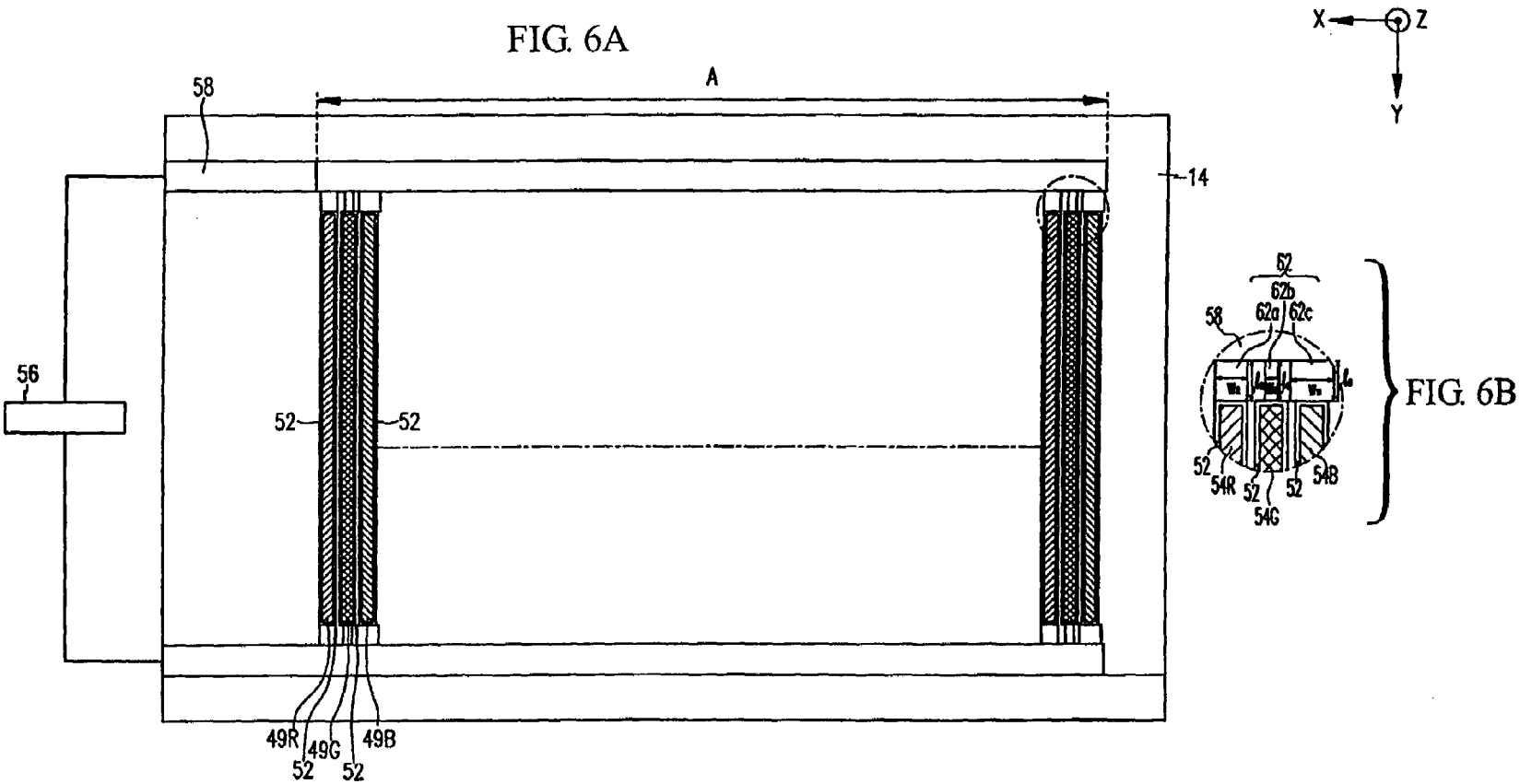
FIGS. 6A and 6B is a plan view and magnified portion of a first variant of the electron emission device according to the second embodiment of the present invention.

FIGS. 6A and 6B is a plan view and a magnified view of a first variant of the electron emission device according to the second embodiment of the present invention. The resistance layers 62 separately connected to the anode electrodes 52 corresponding to the red, green and blue phosphor layers 54R, 54G and 54B have the same length but are differentiated in width, corresponding to the red, green and blue phosphor layers 54R, 54G and 54B.

That is, the respective resistance layers 62*a*, 62*b* and 62*c* are structured to satisfy the following condition: $w_B > w_R > w_G$.

In the first variant, the resistance layers 62*a*, 62*b* and 62*c* are differentiated in width, and hence, different anode voltages are supplied to the anode electrodes 52, thereby compensating for the luminance characteristics related to the red, green and blue phosphor layers 54R, 54G and 54B.

The operation of the resistance layers 62*a*, 62*b* and 62*c* is like that of the second embodiment, and a detailed explanation thereof has been omitted.

Figures 7A, 7B:
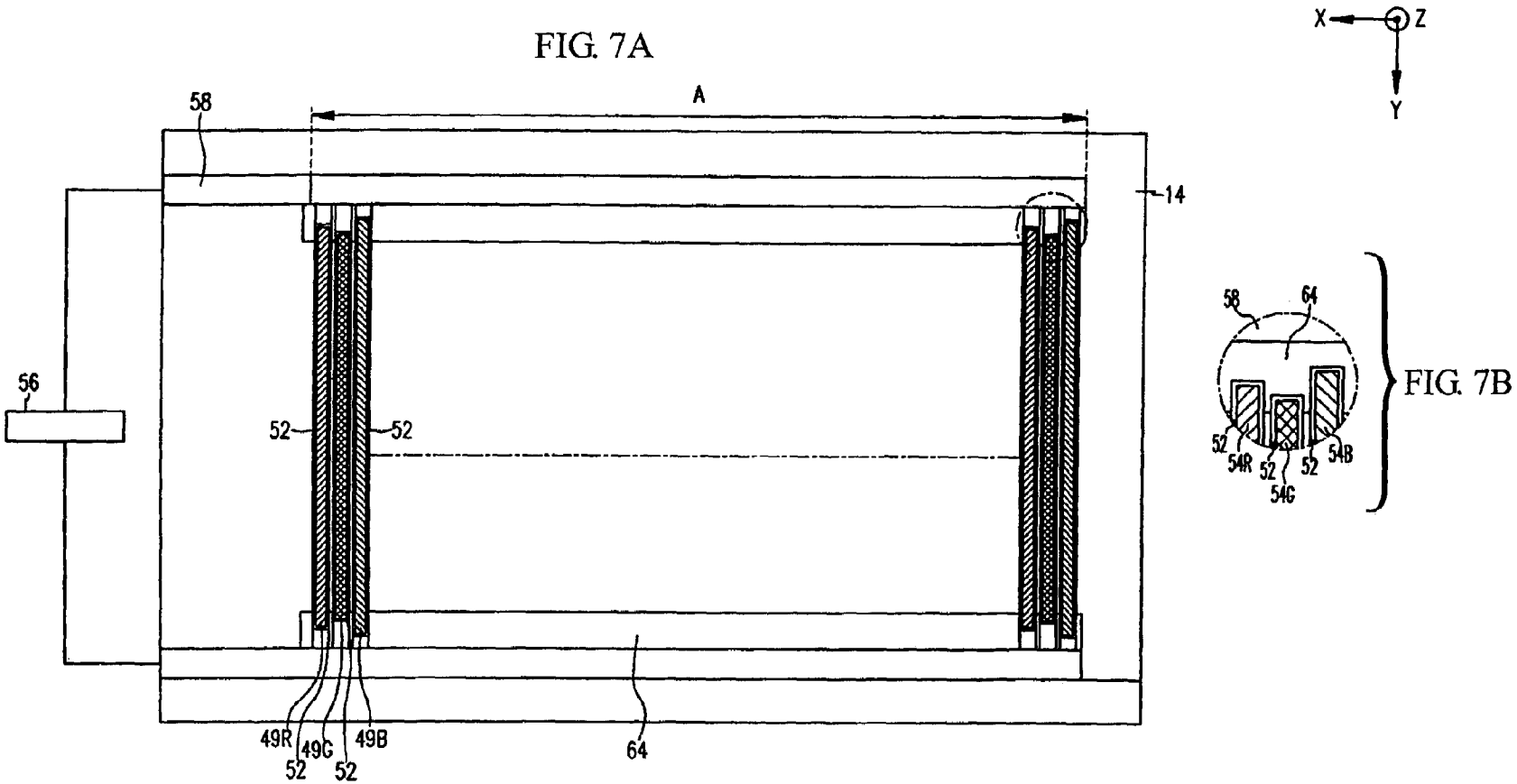
FIGS. 7A and 7B is a plan view and magnified portion of a second variant of the electron emission device according to the second embodiment of the present invention.

FIGS. 7A and 7B is a plan view and a magnified view of a second variant of the electron emission display according to the second embodiment of the present invention. In the second variant, the anode electrodes 52 and the red, green and blue phosphor layers 54R, 54G and 54B are like those related to the second embodiment as well as the first variant thereof.

In the second variant, each resistance layer 64 is disposed between the lead-in portion 58 formed on the anode substrate 5 and the anode electrodes 52 and electrically connected thereto. The resistance layer 64 is linear-shaped while longitudinally proceeding in the long axis (X) direction of the anode substrate 50.

The resistance layer 64 is formed of the same material and thickness as those of the second embodiment and the first variant thereof. The respective anode electrodes 52 connected to the resistance layer 64 have different lengths corresponding to the red, green and blue phosphor layers 54R, 54G and 54B.

That is, the anode electrode 52 corresponding to the blue phosphor layer 54B has the greatest length, and the length of the anode electrode 52 corresponding to the red phosphor layer 54R is greater than that of the anode electrode 52 corresponding to the green phosphor layer 54G.

When the anode electrodes 52 are connected to the resistance layer 64, as shown in FIGS. 7A and 7B, the distance between the end of the resistance layer 64 and the end of the respective anode electrodes 52 is enlarged with the sequence of the anode electrodes 52 corresponding to the red phosphor layer 54R, the blue phosphor layer 54B and green phosphor layer 54G.

The interconnection structure of the resistance layer 64 and the anode electrodes 52 is similar to that of the resistance layers 58 and the anode electrodes 52 shown in FIGS. 5A and 5B, and the effect of the resistance layer is expected to be similar.

In this case, each resistance layer 64 is singly connected to the plurality of anode electrodes 52 while enhancing the luminance characteristics of the red, green and blue phosphor layers 54R, 54G and 54B, the steps of processing the resistance layer 64 can be simplified.

FIGS. 8A1 to 8C1 and 8A2 to 8C2 are plan views and magnified portions of an electron emission device according to a third embodiment of the present invention, including the anode substrate thereof and the main components formed thereon.

In this embodiment, the resistance layer related to the first embodiment and the resistance layer related to the second embodiment are all used. FIGS. 8A1 and 8A2 illustrate a case where the resistance layer related to the first embodiment is provided as a first resistance layer 70, and the resistance layer related to the second embodiment as a second resistance layer 72.

FIGS. 8B1 and 8B2 illustrate a case where the resistance layer related to the first embodiment is provided as a first resistance layer 74, and the resistance layer related to the first variant of the second embodiment as a second resistance layer 76.

FIGS. 8C1 and 8C2 illustrate a case where the resistance layer related to the first embodiment is provided as a first resistance layer 78, and the resistance layer related to the second variant of the second embodiment as a second resistance layer 80.

As described above, with the third embodiment, the resistance layer for protecting the anode electrode and/or the phosphor layer (the first resistance layer) and the resistance layer for enhancing the luminance of the phosphor layer (the second resistance layer) are all used to exert all the effects thereof.

With the electron emission unit formed at the cathode substrate, cathode electrodes are first formed on the cathode substrate, and gate electrodes are then formed over the cathode electrodes while interposing an insulating layer, but the structure of the electron emission unit is not limited thereto. For instance, it is also possible that gate electrodes are first formed on the cathode substrate, and cathode electrodes are then formed over the gate electrodes while interposing an insulating layer.

As described above, resistance layers are electrically connected to the plane or linear-shaped anode electrodes to prevent the anode electrodes and/or the phosphor layers from being damaged due to the arcing, and to compensate for the luminance characteristics of the red, green and blue phosphor layers, thereby enhancing the luminance uniformity.

Although exemplary embodiments of the present invention have been described in detail hereinabove, it should be clearly understood that many variations and/or modifications of the basic inventive concept taught herein will still fall within the spirit and scope of the present invention, as defined by the following claims.

What is claimed is:

1. An electron emission device comprising:

a first substrate;

at least one anode electrode arranged on the substrate;

phosphor layers arranged on the at least one anode electrode; and resistance layers arranged on the substrate and electrically connected to the at least one anode electrode;

wherein the resistance layers are separated from the at least one anode electrode and are arranged at an area of anode voltage lead-in portions arranged on the substrate and connected to the at least one anode electrode; and wherein two or more voltage lead-in portions are arranged on the substrate, and each resistance layer is arranged between the voltage lead-in portions and electrically connected to the voltage lead-in portions.

2. The electron emission display of claim 1, wherein the at least one anode electrode is plane-shaped corresponding to the entire effective display area defined over the substrate.

3. The electron emission display of claim 2, wherein the at least one anode electrode comprises a transparent material arranged on the substrate, and wherein the phosphor layers are patterned on the at least one anode electrode.

4. The electron emission display of claim 2, wherein the phosphor layers are patterned on the substrate, and the at least one anode electrode comprises a metallic material arranged on the substrate to cover the phosphor layers.

5. An electron emission device comprising:

a first substrate;

at least one anode electrode arranged on the substrate;

phosphor layers arranged on the at least one anode electrode; and resistance layers arranged on the substrate and electrically connected to the at least one anode electrode;

wherein the at least one anode electrodes includes a plurality of anode electrodes patterned on the substrate;

wherein the resistance layers are arranged between anode voltage lead-in portions formed on the substrate and the plurality of anode electrodes and are electrically connected thereto;

wherein each resistance layer is singly connected to the plurality of anode electrodes; and wherein the plurality of anode electrodes have different lengths corresponding to the different-colored phosphor layers.

6. The electron emission device of claim 5, wherein the anode electrodes are linear-shaped and arranged longitudinally in a direction of the substrate.

7. An electron emission device comprising:

a first substrate;

at least one anode electrode arranged on the substrate;

phosphor layers arranged on the at least one anode electrode; and resistance layers arranged on the substrate and electrically connected to the at least one anode electrode;

wherein the at least one anode electrodes includes a plurality of anode electrodes patterned on the substrate;

wherein the resistance layers are arranged between anode voltage lead-in portions formed on the substrate and the plurality of anode electrodes and are electrically connected thereto;

wherein the resistance layers are separately arranged on the substrate in a one to one correspondence with the plurality of anode electrodes; and wherein the resistance layers have different resistance values depending upon the colors of the phosphor layers formed on the plurality of anode electrodes.

8. The electron emission display of claim 7, wherein the resistance layers corresponding to the different-colored phosphor layers have the same width, but have different lengths.

9. The electron emission display of claim 8, wherein the phosphor layers are comprise red, green and blue phosphor layers, and when the length of the resistance layer corresponding to the red phosphor layer is $l_R$, the length of the resistance layer corresponding to the green phosphor layer is $l_G$ and the length of the resistance layer corresponding to the blue phosphor layer is $l_B$, the resistance layers satisfy the condition: $l_G>l_R>l_B$.

10. The electron emission device of claim 7, wherein the resistance layers corresponding to the different-colored phosphor layers have the same length, but have different widths.

11. The electron emission device of claim 10, wherein the phosphor layers comprise red, green and blue phosphor layers, and when the width of the resistance layer corresponding to the red phosphor layer is $w_R$, the width of the resistance layer corresponding to the green phosphor layer is $w_G$ and the width of the resistance layer S corresponding to the blue phosphor layer is $w_B$, the resistance layers satisfy the condition: $w_B>w_R>w_G$.

12. An electron emission device comprising:

a first substrate;

at least one anode electrode arranged on the substrate;

phosphor layers arranged on the at least one anode electrode; and resistance layers arranged on the substrate and electrically connected to the at least one anode electrode;

wherein each resistance layer includes a first resistance layer arranged at an area of an anode voltage lead-in portion on the substrate and connected to at least one anode electrode, and a second resistance layer arranged between the anode voltage lead-in portion and the at least one anode electrode and electrically connected thereto.

13. The electron emission device of claim 12, wherein a thickness of the first resistance layer is greater than a thickness of the second resistance layer.

14. The electron emission device of claim 12, further comprising a second substrate facing the first substrate, and an electron emission unit arranged on the second substrate.

* * * * *